US010679841B2

(12) United States Patent
Oser et al.

(10) Patent No.: US 10,679,841 B2
(45) Date of Patent: Jun. 9, 2020

(54) METHOD AND APPARATUS FOR IMPROVED MASS SPECTROMETER OPERATION

(71) Applicant: Thermo Finnigan LLC, San Jose, CA (US)

(72) Inventors: Harald Oser, San Carlos, CA (US); Qingyu Song, Fremont, CA (US); Mikhail V. Ugarov, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 16/169,900

(22) Filed: Oct. 24, 2018

(65) Prior Publication Data

US 2019/0385832 A1 Dec. 19, 2019

Related U.S. Application Data

(60) Provisional application No. 62/684,344, filed on Jun. 13, 2018.

(51) Int. Cl.
*H01J 49/00* (2006.01)
*H01J 49/42* (2006.01)

(52) U.S. Cl.
CPC ..... *H01J 49/429* (2013.01); *H01J 49/4215* (2013.01)

(58) Field of Classification Search
CPC ..... H01J 49/00; H01J 49/02; H01J 49/0009; H01J 49/0027; H01J 49/0031;
(Continued)

(56) References Cited

U.S. PATENT DOCUMENTS 8,084,733 B2 12/2011 Russ, IV et al.
8,735,807 B2 5/2014 Mitchell et al.
(Continued)

FOREIGN PATENT DOCUMENTS

JP 5012965 B2 6/2010
JP 2013175297 A 9/2013

OTHER PUBLICATIONS

Longerich, et al., "Laser Ablation Inductively Coupled PlasmaMass Spectrometric Transient Signal Data Acquisition and Analyte Concentration Calculation", Journal of Analytical Atomic Spectrometry, 1996, vol. 11, pp. 899-904.
(Continued)

*Primary Examiner* — Jason L McCormack
(74) *Attorney, Agent, or Firm* — Thomas F. Cooney; A. J. Gokcek

(57) ABSTRACT

A method of operating a quadrupole mass filter is disclosed. A first set of RF and resolving DC voltages are applied to electrodes of a quadrupole mass filter to selectively transmit first ions having a first mass-to-charge ratio (m/z). A second set of RF and resolving DC voltages are applied to electrodes of the quadrupole mass filter to selectively transmit second ions having a second m/z. Detection of the second ions is initiated after completion of a settling time. The settling time is determined in accordance with the relationship: Eq. 1, where $t_s$ is the settling time, $(m/z)_1$ is the first mass-to-charge ratio, $(m/z)_2$ is the second mass-to-charge ratio and A, B and C are empirically derived coefficients.

4 Claims, 9 Drawing Sheets

(58) Field of Classification Search
CPC .... H01J 49/0036; H01J 49/0045; H01J 49/06; H01J 49/062; H01J 49/063; H01J 49/42; H01J 49/421; H01J 49/4215; H01J 49/427; H01J 49/426; H01J 49/4295; H01J 49/429
USPC ..... 250/281, 282
See application file for complete search history.

(56) References Cited

U.S. PATENT DOCUMENTS

| | | | | |
|---|---|---|---|---|
| 9,269,551 | B2 | 2/2016 | Ueda | |
| 9,548,193 | B2 | 1/2017 | Mukaibatake et al. | |
| 2002/0121597 | A1* | 9/2002 | Tanner | H01J 49/421 250/288 |
| 2012/0286148 | A1* | 11/2012 | Kawana | H01J 49/0077 250/281 |
| 2013/0105681 | A1* | 5/2013 | Kovtoun | H01J 49/0481 250/282 |
| 2014/0131569 | A1* | 5/2014 | Guna | H01J 49/004 250/284 |
| 2015/0228465 | A1 | 8/2015 | Bateman et al. | |
| 2016/0284531 | A1* | 9/2016 | Zaks | H01J 49/401 |
| 2017/0047212 | A1 | 2/2017 | Kenny | |
| 2017/0168031 | A1* | 6/2017 | Verenchikov | G01N 30/7206 |
| 2017/0299558 | A1* | 10/2017 | Stevens | H01J 49/0031 |

OTHER PUBLICATIONS

Thomas, "A Beginner's Guide to ICP-MS, Part XI—Peak Measurement Protocol", Tutorial, Spectroscopy 17 (7), 2002, pp. 28-35.
Wong, et al., "An Evaluation of Triple Quadrupole Mass Spectrometry/Mass Spectrometry (MS/MS) for On-Line Gas Analysis of Trace Sulfur Compounds from Oil Shale Processing", Mass Spectrometric Characterization of Shale Oils, ed. T. Aczel (West Conshohocken, PA: ASTM International, 1986), pp. 106-120. https://doi.org/10.1520/STP18317S.
Agilent, "Dynamically Adjusted Mass Axis Delay Times for Optimized Multiple Reaction Monitoring (MRM) Data Acquisition", Poster, ASMS 2018, XP055633243. Retrieved from the Internet:URL:https://www.agilent.com/cs/library/posters/public/AGILENT_ASMS2018_MP387.pdf.

* cited by examiner

METHOD AND APPARATUS FOR IMPROVED MASS SPECTROMETER OPERATION

CROSS REFERENCE TO RELATED APPLICATION

This application claims, under 35 U.S.C. § 119(e), the right of priority to and the benefit of the filing date of co-owned U.S. Provisional Application No. 62/684,344, which was filed on Jun. 13, 2018 and which is titled "Method and Apparatus for Improved Mass Spectrometer Operation," said provisional application incorporated herein by reference in its entirety.

FIELD OF THE INVENTION

This invention relates to quadrupole mass filters. More specifically, this invention relates to measuring and utilizing the settling time of a quadrupole mass filter as a function of quadrupole electronics and ion time of flight.

BACKGROUND OF THE INVENTION

Quadrupoles are ion confinement devices that are utilized to perform several important functions within mass spectrometer systems. For example, such devices are frequently employed as simple ion guides, as mass filters, as ion storage devices, as ion trap mass analyzers and as ion/ion or ion/molecule reaction cells. In a common configuration, a quadrupole comprises four parallel or substantially parallel rod electrodes that define a central axis and to which a Radio Frequency (RF) oscillatory voltage waveform is applied, with a first RF phase, $\phi$, applied to a first set of diametrically opposed rods and a second RF phase, equal to $(\phi+\pi)$ applied to the other pair of diametrically opposed rods.

During operation in "RF-only" mode, ion species comprising a wide range of mass-to-charge ratio (m/z) values assume so-called "stable" trajectories between the rods and thus remain confined within the quadrupole to a zone about the central axis. If electrical potential barriers are imposed via gate electrodes at either end of such an RF-only quadrupole, then it may function as an ion store. However, if an electrical potential gradient is applied between the two ends, then the apparatus is an ion guide.

If an additional direct-current (DC) potential difference is applied between the two pairs of diametrically opposed rods (that is, with the rods of one pair at a first potential and the rods of the other pair at a second potential), then a quadrupole may be operated as a mass filter. The difference between the DC potential applied to the first pair of rods and the second pair of rods is herein referred to as a "resolving DC voltage". The motion of ions in such a device is subject to the well-known Mathieu equation, the various parameterized solutions of which are as shown in a conventional Mathieu stability diagram, as depicted in FIG. 8A. An ion of a specific mass-to-charge ratio (m/z) will have a stable trajectory within the quadrupole if the applied RF and DC voltage amplitudes, respectively V and U, the RF frequency, $\Psi$, the dimensional parameter, $r_0$, and the ion's m/z are all such that the Mathieu q and a parameters plot within the "X & Y" stable region of the diagram. Such stable-trajectory ions can pass through the quadrupole whereas other ions whose m/z values correspond to either the "Y Unstable" or the "X Unstable" region will ejected off axis and/or neutralized.

The hypothetical ion species that corresponds to point 15 in FIG. 8B is an example of an ion species that would have a stable trajectory within a quadrupole and that would accordingly be able to pass completely through the quadrupole. Given a sample of ions comprising numerous species having respective different m/z values, all such ions correspond to points along line 11, the extension of which passes through the origin of the plot. Thus, all ion species whose Mathieu a and q points plot along the solid-line portion of line 11 that is disposed between intersection points 12 and 14 can pass through the quadrupole. Conversely, hypothetical ion species of the sample whose Mathieu a and q points plot along the dashed-line portions of line 11, such as points 13 and 16, would not pass completely through the quadrupole. The range of m/z values corresponding to all points within the solid-line portion of line 11 may be referred to as the bandpass of the quadrupole mass filter. Generally, when isolating ion species, it is desirable to choose the bandpass to be as narrow as possible, which may be accomplished by increasing the U/V ratio so that the line 11 passes closely to the apex 18 of the diagram.

Qualitative and quantitative mass spectral studies are frequently performed using one or more quadrupoles operating as mass filters. In the experimental mode of operation known as selected ion monitoring (SIM) or multiple ion monitoring (MIM), individual discrete selected ion species of interest are transmitted to a detector, one at a time and without fragmentation. This mode of operation is useful when only certain specific pre-determined analyte compounds are being searched for or otherwise targeted and the initial ionization of each such compound yields at least one diagnostic ion species (i.e., a respective diagnostic m/z value per compound). In an ideal case, only ions comprising a single one of the pre-determined m/z values can pass through the quadrupole to a detector at each detection step, with ions of all other m/z values being filtered out. In general practice, the analysis is performed using a narrow bandpass (e.g., ±1 Th) at each filtering step.

Other common experimental studies employ multi-stage or tandem mass spectrometry that includes two or more stages of mass selection, separation and/or analysis, typically with ions being fragmented between these stages. For instance, a tandem quadrupole mass spectrometer generally consists of first quadrupole that is operated as a mass filter, followed by a second quadrupole that is operated as a collision cell, followed by a third quadrupole that is operated as a mass filter, followed by an ion detector. The procedure for performing tandem mass spectrometry so as to identify a particular analyte is sometimes referred to as selected reaction monitoring (SRM), where the first quadrupole mass filter is initially set to only transmit parent or precursor ions having a single specific pre-determined precursor-ion m/z. These precursor ions are then fragmented in the collision cell and the resulting fragment ions are directed towards the third quadrupole (a second mass filter) which is set to transmit only fragment ions having a specific pre-determined fragment-ion m/z towards the ion detector. Each so-called "reaction" or "transition" of an SRM experiment thus comprises a precursor-fragment ion pair. In targeted experiments, the particular precursor-ion m/z values that are to be isolated for subsequent fragmentation and the particular fragment-ion m/z values that are to be isolated for subsequent detection may be pre-determined prior to an experiment. Alternatively, in so-called data-dependent experiments, the results of immediately preceding measurements may form the basis for automatic real-time software decision steps that determine which specific precursor ion species are fragmented.

When conducting mass spectral studies according to any of the mass spectral modes of operation discussed above, it is necessary to re-configure the operation of at least one quadrupole mass filter so that, after the reconfiguration, it will isolate an ion species having an m/z value that differs from the m/z value an ion species that was previously isolated by the same quadrupole mass filter (in other words, selectively transmitted completely through the quadrupole mass filter). A schematic example of such reconfiguration is illustrated in FIG. 8B. For example, assume that point 15 represents the Mathieu plot of the pre-determined m/z value, $(m/z)_1$, of a first ion species while that species is being isolated. Further assume that that point 13 represents the plot of the pre-determined m/z value, $(m/z)_2$, of the other ion species during the time that the first ion species, $(m/z)_1$, is being isolated. The applied DC voltage, U, and RF voltage amplitude, V, are held constant during the period of time, termed a "dwell time", that the first ion species is being isolated. Because point 13 is disposed within the "Y Unstable" field of the diagram, the $(m/z)_2$ species is prevented from completely passing through the quadrupole during this dwell time period.

Subsequently, the quadrupole mass filter is rapidly reconfigured so that the $(m/z)_2$ species is able to completely pass through the quadrupole mass filter. The reconfiguration causes the Mathieu representation of $(m/z)_2$ to move from point 13 to point 15 and also causes the Mathieu representation of $(m/z)_1$ to move from point 15 to point 16. In the reconfigured state, the trajectories of the $(m/z)_2$ ion species are stable whereas the those of the $(m/z)_1$ ion species are unstable. In this reconfigured state, the applied DC voltage, U, and applied RF voltage amplitude, V, are held constant at their new values during for a second dwell time period while the second ion species is being isolated. From the diagram, it may be seen that the reconfiguration corresponds to an essentially discontinuous change, Δa, in the Mathieu a parameter as well as a simultaneous essentially discontinuous change, Δq, in the Mathieu q parameter. Operationally, the reconfiguration corresponds to simultaneous essentially discontinuous changes in DC voltage, U, and RF voltage amplitude, V.

Unfortunately, it is found that, when the voltage set-points are rapidly changed from a first setting to a second setting, the electrical system responds with a period of hysteresis comprising multiple voltage overshoots interspersed with undershoots. During the hysteresis period, it is not possible to reliably isolate any particular ion species and further analysis operations must therefore be delayed until the voltages settle at stable constant values. Because of the abrupt drop in the applied voltages, several milliseconds are generally required for the voltages to stabilize. This "settling time" is the extra time needed, before a next measurement or scan can be performed and data collected, for the RF and DC voltages to stabilize and for a resulting stable ion flux to be received at a detector. The inventors have found that the settling time depends on both the difference between the initial and final m/z values as well as on the final m/z value, as discussed further herein below.

Increased speed of resumption of data acquisition after stabilization of quadrupole mass filter voltages is advantageous for applications that target tens or hundreds of SRM transitions. Timely setting of RF/DC voltages on the rods of the quadrupole mass filter after each transition is particularly important to guarantee efficient, reproducible performance at very short dwell times.

U.S. Pat. No. 9,548,193 discloses a mass spectrometer with a quadrupole mass filter for selectively allowing an ion having a specific m/z to pass therethrough, a quadrupole driver for applying a predetermined voltage to each of the electrodes comprising the quadrupole mass filter, and a controller for controlling the quadrupole driver in such a manner as to change the voltage applied to each of the electrodes of the quadrupole mass filter during the scan measurement for a plurality of masses, while changing the waiting time from the termination of one cycle to the initiation of the subsequent cycle in accordance with the mass difference between the initiation mass and the termination mass in a cycle. The step of reducing the mass width of the scan range is said to reduce the time which does not substantially contribute to the mass analysis as much as possible so as to shorten the cycle period. While this approach may reduce the settling time from one cycle to the next, the mass difference between the initiation mass and the termination mass in a cycle can still lead to a larger than ideal voltage overshoot or undershoot, resulting in longer than necessary settling times. Furthermore, the longer settling time needed from cycle to cycle causes undesired ions to remain inside the mass quadrupole filter and reach the detector, which impedes an acquisition of accurate signal intensity.

What are therefore needed are methods of optimizing the operation of a quadrupole mass filter or of a mass spectrometer system comprising one or multiple quadrupole mass filters, such that RF/DC settling times and other delay times that are associated with the quadrupole mass filter or mass filters are accurately accounted for, which will allow measurement of more transitions and acquisition of more data points, per unit of time, without loss of data quality. Preferably, mass spectral data acquisition should not begin prior to voltages becoming stable at the end of a settling period but the commencement of such data acquisition should occur as soon as possible after or, preferably, immediately at the end of the settling period.

SUMMARY

Methods of operating a quadrupole mass filter or of operating a mass spectrometer system comprising multiple quadrupole mass filters for selectively transmitting ions of a specified mass-to-charge ratio (m/z) are provided. In accordance with a first aspect of the present teachings, a method of operating a quadrupole mass filter is disclosed. An exemplary method includes causing the quadrupole mass filter to selectively transmit first ions having a first m/z by applying a first set of RF and resolving DC voltages to electrodes of the quadrupole mass filter. Subsequent to selective transmission of the first ions, the method further includes causing the quadrupole mass filter to selectively transmit second ions having a second m/z by applying a second set of RF and resolving DC voltages to electrodes of the quadrupole mass filter. The method also includes initiating detection of the second ions after completion of a settling time, wherein the settling time is determined in accordance with the relationship:

$$t_s = A[(m/z)_2 - (m/z)_1]^B + C\sqrt{(m/z)_2}$$

where $t_s$ is the settling time, $(m/z)_1$ is the first mass-to-charge ratio, $(m/z)_2$ is the second mass-to-charge ratio and A, B and C are empirically derived coefficients. The coefficients A and B are electronics settling time coefficients, and the coefficient C is a time of flight (TOF) coefficient.

The values of A and B may be dependent on whether the m/z of a next target ion is greater than or less than the m/z of a previous target ion. In some embodiments, the settling time is determined for each ion of a target list. The ions may be in, but are not limited to, a range of 5 Th to 3000 Th, which is the full range of some presently-available individual commercial mass spectrometer systems.

According to a second aspect of the present teachings, a mass spectrometer system for selectively detecting or quantifying ions of a specified m/z is disclosed. The mass spectrometer system comprises a quadrupole mass filter that includes four elongate electrodes arranged in generally parallel relation; RF and resolving DC voltage supplies for respectively applying RF and DC voltages of controllable amplitude or magnitude to the electrodes; and a detector located downstream of the electrodes for detecting the selectively transmitted ions. The mass spectrometer system further includes a control system. The control system, coupled to the RF and resolving DC voltage supplies and the detector, has logic for: causing the RF and DC voltage supplies to apply a first set of RF and resolving DC voltages to the electrodes, wherein the first set of voltages are set to selectively transmit first ions having a first m/z; causing the RF and DC voltage supplies to apply a second set of RF and resolving DC voltages to the electrodes, wherein the second set of voltages are set to selectively transmit second ions having a second m/z; and causing the detector to initiate detection of the second ions after completion of a settling time. The settling time is determined in accordance with the relationship:

$$t_s = A[(m/z)_2 - (m/z)_1]^B + C\sqrt{(m/z)_2}$$

where $t_s$ is the settling time, $(m/z)_1$ is the first mass-to-charge ratio, $(m/z)_2$ is the second mass-to-charge ratio and A, B and C are empirically derived coefficients.

According to another aspect of the present teachings, a method of operating a tandem mass spectrometer is disclosed. The tandem mass spectrometer includes a first quadrupole mass filter (Q1), a quadrupole collision cell (Q2) disposed to receive ions from the first quadrupole mass filter, and a second quadrupole mass filter (Q3) that is disposed to receive ions from the quadrupole collision cell. The method includes applying a first set of RF and resolving DC voltages to electrodes of the first and second quadrupole mass filters to cause the first quadrupole mass filter (Q1) to selectively transmit first precursor ions to the collision cell and to cause the second quadrupole mass filter (Q3) to selectively transmit first product ions that are received from the collision cell to a detector. The method also includes applying a second set of RF and resolving DC voltages to electrodes of the first and second quadrupole mass filters to cause the first quadrupole mass filter (Q1) to selectively transmit second precursor ions to the collision cell and to cause the second quadrupole mass filter (Q3) to selectively transmit second product ions to the detector, wherein either a mass-to-charge (m/z) range of the first precursor ions differs from an m/z range of the second precursor ions or an m/z range of the first product ions differs from an m/z range of the second product ions. The method further includes initiating detection of the second ions after completion of a settling time, $t_{s\text{-}tot}$ that is calculated as $$t_{s\text{-}tot} = \mathrm{MAX}\{(t_{Q1s} + t_{Q2s}), t_{Q3s}\}$$

where $t_{Q1s}$ is the settling time for Q1, $t_{Q2s}$ is the settling time for Q2, $t_{Q3s}$ is the settling time for Q3. The individual settling times for the Q1 mass filter, the Q2 collision cell, and the Q3 mass filter may be determined in accordance with the respective relationships:

$$t_{Q1s} = A[(m/z)_2 - (m/z)_1]^B + C\sqrt{(m/z)_2},$$

$$t_{Q2s} = C^*\sqrt{(m/z)_{p2}},$$

$$t_{Q3s} = A[(m/z)_{p2} - (m/z)_{p1}]^B + C(m/z)_{p2},$$

where $(m/z)_1$ is the first precursor-ion mass-to-charge ratio, $(m/z)_2$ is the second precursor-ion mass-to-charge ratio, $(m/z)_{p1}$ is the first product-ion mass-to-charge ratio, $(m/z)_{p2}$ is the second product-ion mass-to-charge ratio, and A, B, C and C* are empirically derived coefficients.

BRIEF DESCRIPTION OF THE DRAWINGS

The above noted and various other aspects of the present invention will become further apparent from the following description which is given by way of example only and with reference to the accompanying drawings, not drawn to scale, in which.

DETAILED DESCRIPTION OF EMBODIMENTS

Figure 1:
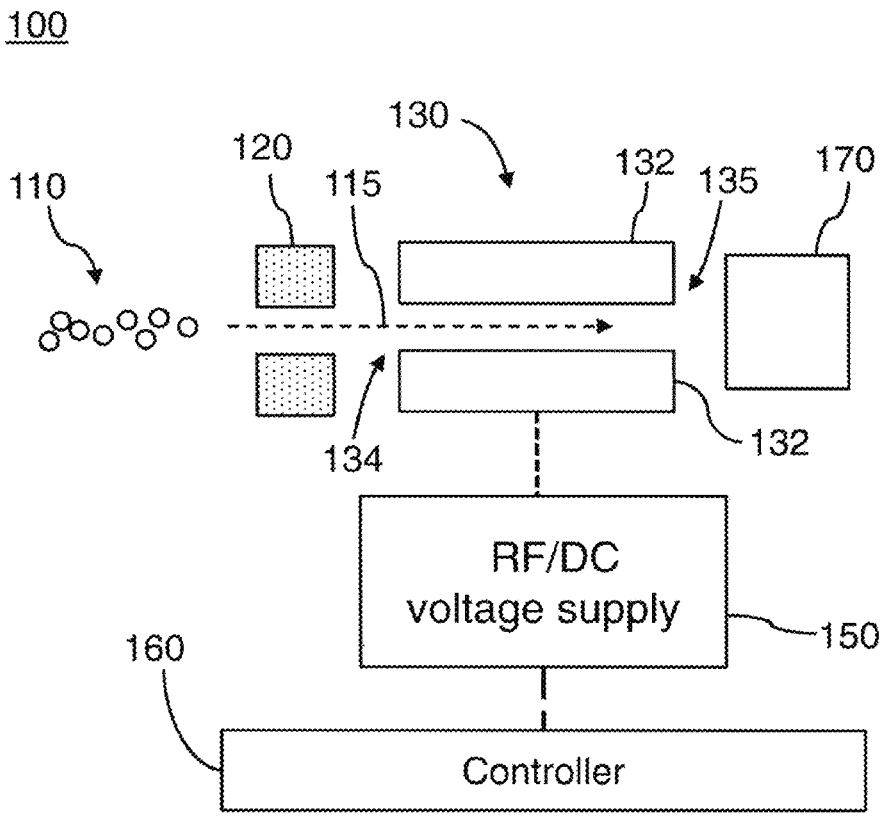
FIG. 1 illustrates a simplified schematic diagram of an example quadrupole mass filter apparatus in accordance with the present teachings.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-7, 8A and 8B.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that, for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

Unless otherwise defined, all technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present description, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting.

As used herein, "a" or "an" also may refer to "at least one" or "one or more." Also, the use of "or" is inclusive, such that the phrase "A or B" is true when "A" is true, "B" is true, or both "A" and "B" are true. As used herein, and as commonly used in the art of mass spectrometry, the term "DC" does not specifically refer to or necessarily imply the flow of an electric current but, instead, refers to a non-oscillatory voltage which may be either constant or variable. The term "RF" refers to an oscillatory voltage or oscillatory voltage waveform for which the frequency of oscillation is in the radio-frequency range.

As used herein, the term "pre-determined", when used in reference to a mass-to-charge range or a mass-to-charge value, is intended to include any one of or any combination of: (a) having been input into computer memory or other electronic memory or by a user by means of a keyboard, a graphical user interface, a touch-screen interface, a mouse or other electronic pointing device, and the like, either during the course of an experiment or measurement or during an experiment or measurement; (b) having been input into a computer or electronic memory by the reading of a value or list of values from an electronic or computer network, an intranet, the Internet or an electronic storage device such as RAM or flash memory, a hard disk drive, a solid-state drive and the like; and (c) having been computed automatically by a computer or electronic processor during a same or an earlier mass spectral measurement or an acquisition of mass spectral data by means of an automated analysis of the earlier mass spectral measurement or mass spectral data. The terms "target" and "targeted", when used in reference to mass-to-charge values, refer to mass-to-charge values that are pre-determined as noted above according to either case (a) or case (b), but not according to case (c). The terms "target" and "targeted", when used herein in reference to ions or ion species refers to ions or ion species having mass-to-charge values that are pre-determined as noted above according to either case (a) or case (b), but not according to case (c). The term "targeted list" refers to a list of targeted ions or targeted ion species, as defined above.

FIG. 1 illustrates a simplified schematic diagram of an example quadrupole mass spectrometer system 100 which may be used to implement certain embodiments of the present invention described herein. Ions 110 comprising a sample are generated in an ionization source (not shown) and transmitted to a quadrupole mass filter 130 via one or more ion optical elements 120 such as, but not limited to, an ion funnel, a stacked ring ion guide, one or more ion guides, one or more ion lenses and one or more ion gating elements. The quadrupole mass filter 130 comprises four substantially parallel rod electrodes 132 (only two of which are illustrated) that, taken together, define a central axis 115. The quadrupole mass filter 130 separates ions according to their mass-to-charge ratio (m/z) in the sense that those ions whose m/z values are within the passband of the mass filter are able to pass completely through the mass filter from an inlet end 134 to an outlet end 135, whereas other ions whose m/z values are not within the mass filter passband are either neutralized or are ejected from the apparatus transverse to the axis 115. It is to be kept in mind that, as the diagram in FIG. 1 is highly schematic, certain common components of a full mass spectrometer system are not illustrated. Such components include a vacuum housing, various vacuum chambers within the housing, an ion source, vacuum pumps, vacuum hoses and connections, electrical connectors, etc.

The set of rod electrodes are provided with RF and resolving DC voltages, as described above, from an RF/DC voltage supply system 150. The voltage supply system 150 may communicate with and operate under the control of controller 160. The controller 160 transmits commands to the voltage supply system 150 that determine the magnitudes of the applied RF and resolving DC voltages, thereby controlling the passband of the mass filter 130. Generally, the width of the passband is chosen to be sufficiently narrow so as to ideally include only one particular pre-determined target ion species, although there is always a possibility that unforeseen contaminant ion species will also be included within the passband. When a specific set of voltages is applied, only ions whose m/z values are within the passband corresponding to the applied voltages are able to pass through the whole length of the quadrupole mass filter 130 to reach detector 170 where the selected m/z ions are detected and a data signal acquired. The other ions are deflected onto trajectories which cause them to collide with the rods or to be ejected transverse to the axis 115. The detector 170, which intercepts ions that pass entirely through the quadrupole mass filter 130, generates a signal representative of the number of transmitted ions. The detector signals are conveyed to a data analysis system, for example, a computer, which may be integral with the controller 160, for processing and generation of either a mass spectrum or other qualitative or quantitative information pertaining to analyte compounds.

The acquisition operation takes a finite time to complete. The time spent analyzing each collection of ions within an m/z passband under conditions of stable, constant voltages applied to the rod electrodes is herein referred to as the "dwell time." After each measurement during a dwell time period, the controller 160 commands the voltage supply 150 to change the applied voltages to a new set of values that correspond to a different m/z passband that, in general, is not overlapping with the immediately preceding m/z passband. It is observed that a certain amount of time delay is required before the next measurement may be performed so that the mass spectrometer system may stabilize. This stabilization time is called the "settling time." The settling time includes the time required for the electronics and electrical system to stabilize at the new values. The settling time also includes the amount of time required for the flux of selected ions that are generated by the newly stabilized voltages to pass completely through the mass filter and to a detector. Thus, when changing from one discrete passband to another, the magnitude of the required time delay is determined, in part, by how quickly the RF/DC voltages can stabilize to proper target values and, in part, by how quickly the ions can traverse the full length of the quadrupole mass filter.

Figure 2:
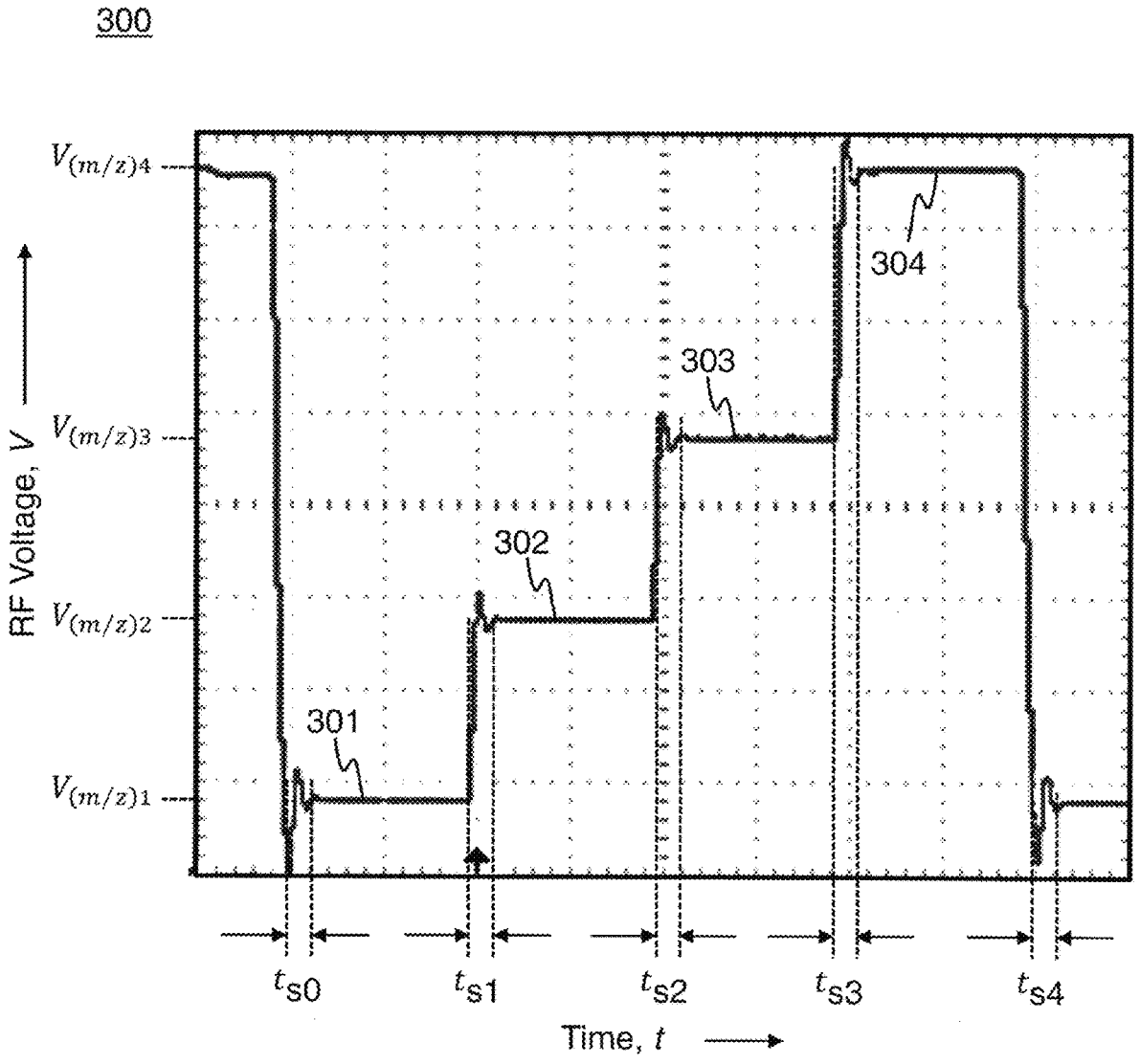
FIG. 2 shows data acquisition periods for each of several isolations of respective ion species of various m/z values, together with intervening settling time periods, during the course of an experiment cycle in which resolving RF and DC voltages applied to a quadrupole mass filter are discontinuously varied.

FIG. 2 shows the settling time and acquisition period for each targeted m/z ion in one experiment cycle as the RF and DC resolving voltages applied to the quadrupole mass filter are changed between different targeted ions. To determine the total settling time, one needs to consider not only the time required for electronic and electrical stabilization after the passband is discontinuously changed from that of a previously selected ion, $(m/z)_1$, to a next targeted ion (e.g. $(m/z)_2$, $(m/z)_3$, etc.), but also needs to consider the time required for the $(m/z)_2$ ions to travel through the entire quadrupole device length in order to generate a stable ion signal of the $(m/z)_2$ ions. As shown in FIG. 2, there may be a large voltage change (a drop or jump) prior to the start of a new cycle. The voltage change may be either in the positive direction or the negative direction. It is found that the settling time is dependent on both the magnitude and the algebraic sign of the voltage change.

Accordingly, with reference to FIG. 2, the settling time is the longest for the greatest voltage change in the cycle, which occurs before the first ions are transmitted.

In the example of FIG. 2, the RF/DC voltages applied to the electrodes of the quadrupole mass filter are changed in a stepped manner from their initial values to values in which the passband encompasses and is preferably centered about the mass-to-charge value, $(m/z)_1$ of the first targeted ion species. (This disposition of the passband relative to the m/z of the targeted ion species is hereinafter referred to as "selective transmission" of the targeted ion species.) The quadrupole voltages must then stabilize before a signal of the first targeted ion species, identified by its mass-to-charge value, $(m/z)_1$, can be acquired. It is only after the voltages have stabilized that a stable flux of the targeted ions can pass through the quadrupole. The front end of this stable ion flux requires additional time, after the voltage stabilization, to traverse the length of the quadrupole mass filter and to reach the detector. Therefore, the required settling time, $t_{s1}$, includes terms relating both to voltage stabilization and to ion time of flight, as discussed further below. Subsequently, the stabilized, constant-voltage plateau 301 of FIG. 2 corresponds to a dwell time during which the $(m/z)_1$ ions (if any) are transmitted to the detector and during which a measurement signal of these ions (if any) is acquired.

Subsequent to the measurement of the $(m/z)_1$ ion species, the RF/DC voltages applied to the quadrupole mass filter quadrupole mass filter are once again essentially discontinuously changed (in this case, increased) so as to selectively transmit a second targeted ion species, identified as $(m/z)_2$, to the detector. The detection of the second $(m/z)_2$ ions, if any, is initiated after completion of a settling time, $t_{s1}$, which includes both electronic/electrical stabilization and ion time-of-flight terms as described further below. The measurement of a signal of the ions (if any) occurs during the dwell time corresponding to the stabilized, constant-voltage plateau 302.

Subsequent to the measurement of $(m/z)_2$ ion species, the RF/DC voltages applied to the quadrupole mass filter quadrupole mass filter are once again essentially discontinuously increased so as to selectively transmit a third targeted ion species, identified as $(m/z)_3$, completely through the quadrupole mass filter and to the detector. The detection of the third targeted ions, $(m/z)_3$, occurs during the dwell time corresponding to stabilized, constant-voltage plateau 303, which is initiated after completion of a settling time, $t_{s2}$, which includes both electronic/electrical stabilization and ion time-of-flight component terms.

Subsequent to the measurement of $(m/z)_3$ ion species, the RF/DC voltages applied to the quadrupole mass filter quadrupole mass filter are once again essentially discontinuously increased so as to selectively transmit a fourth targeted ion species, identified as $(m/z)_4$, completely through the quadrupole mass filter and to the detector. The detection of the fourth targeted ions, $(m/z)_3$, occurs during the dwell time corresponding to stabilized, constant-voltage plateau 304, which is initiated after completion of a settling time, $t_{s3}$, which includes both electronic/electrical stabilization and ion time-of-flight component terms. After the measurement of $(m/z)_3$ ion species, a new measurement cycle may begin. In this example, the initiation of the new cycle comprises re-setting the RF/DC voltages so as to once again selectively transmit the first targeted ion species, $(m/z)_1$, with a corresponding settling time, $t_{s4}$. It will be appreciated by one of ordinary skill in the art that, in the example of FIG. 2, more precursor ions or fewer precursor ions may be targeted in a complete cycle. One of ordinary skill in the art will also appreciate that the settling time may be measured with a negative RF voltage that is reduced or stepped down (instead of increased, as shown) between successive data acquisition dwell times.

Figure 3:
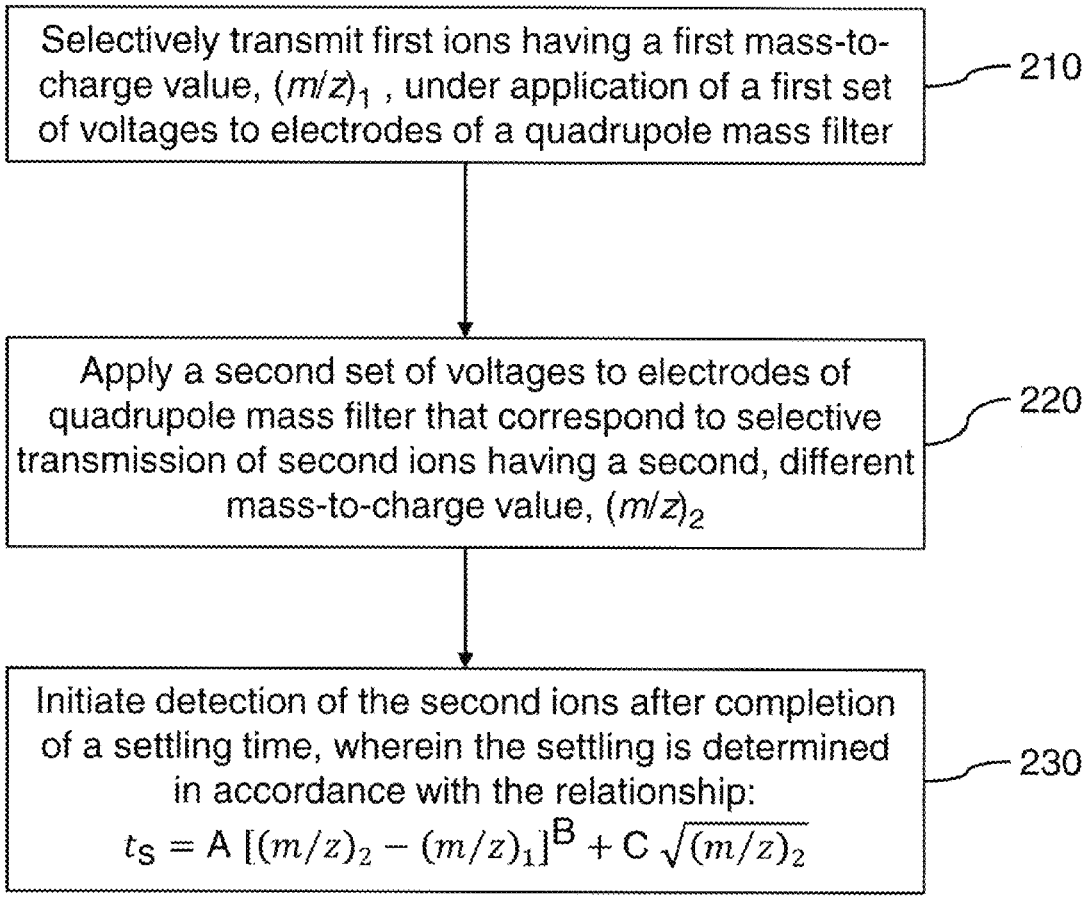
FIG. 3 is a flowchart depicting steps of a method of operating a quadrupole mass filter, in accordance with certain aspects of the present teachings.

FIG. 3 is a flowchart depicting steps of an exemplary method 200 of operating a quadrupole mass filter, in accordance with the present teachings. In Step 210, the quadrupole mass filter selectively transmits first ions having a first m/z under application of a first set of RF and resolving DC voltages to electrodes of the quadrupole mass filter. Next, in step 220, the voltages applied to the electrodes of the quadrupole mass filter are changed such that a second set of RF and resolving DC voltages are applied to the electrodes, wherein the second set of voltages corresponds to selective transmission, through the quadrupole mass filter, of second ions having a second m/z that is different than the first m/z. Next, in step 230, detection of the second ions is initiated after completion of a settling time. The settling time, which is determined for each ion of a list of targeted ion species, is determined in accordance with the following relationship:

$$t_s = A[(m/z)_2 - (m/z)_1]^B + C\sqrt{(m/z)_2} \quad \text{Eq. 1}$$

where $t_s$ is the settling time, $(m/z)_1$ is the first mass-to-charge ratio, $(m/z)_2$ is the second mass-to-charge ratio and A, B and C are empirically derived coefficients which must be determined by instrument calibration.

Figure 6:
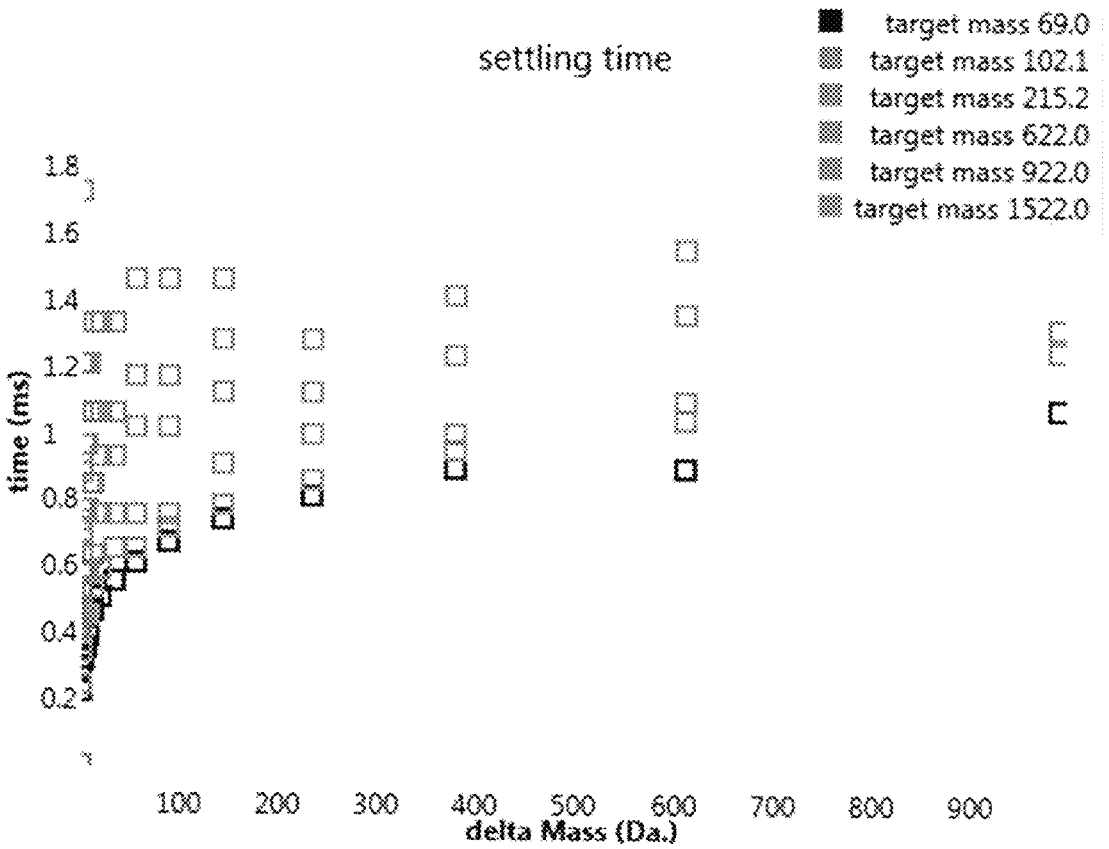
FIG. 6 shows the settling time as a function of a discontinuous change in isolated m/z for several targeted precursor ions.
Figure 7:
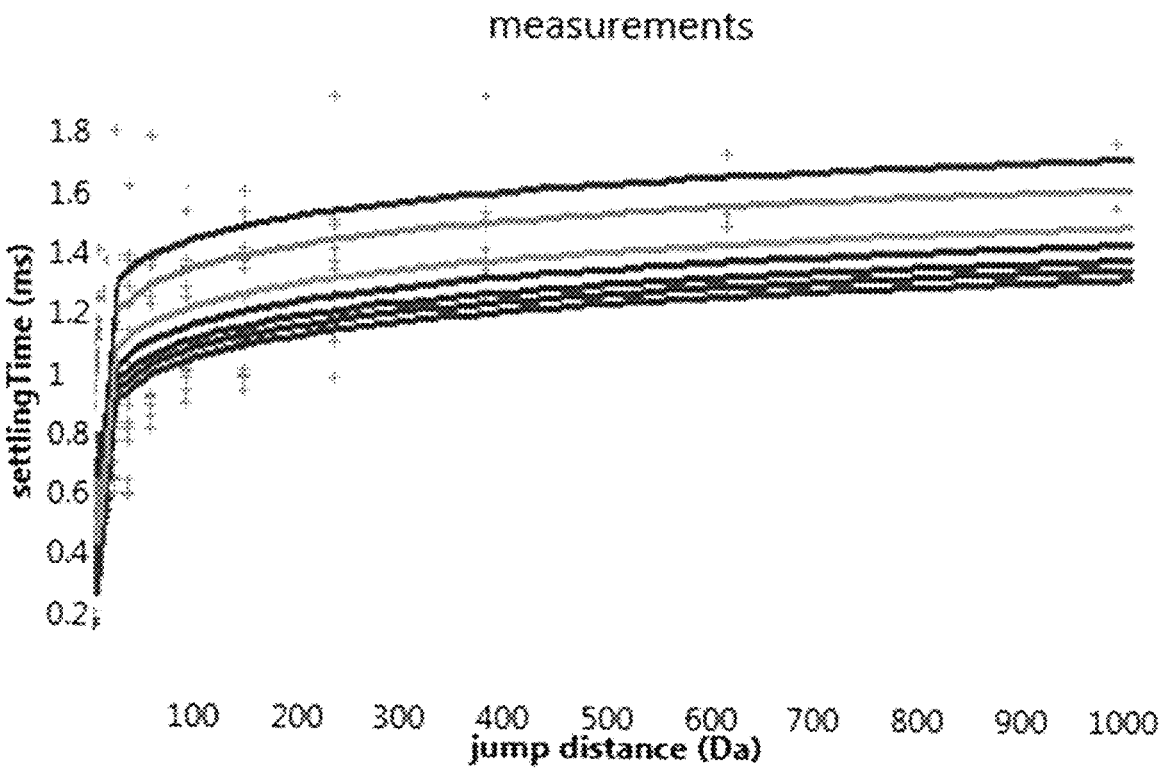
FIG. 7 shows a nonlinear curve fit of the data depicted FIG. 6.
Figure 8A:
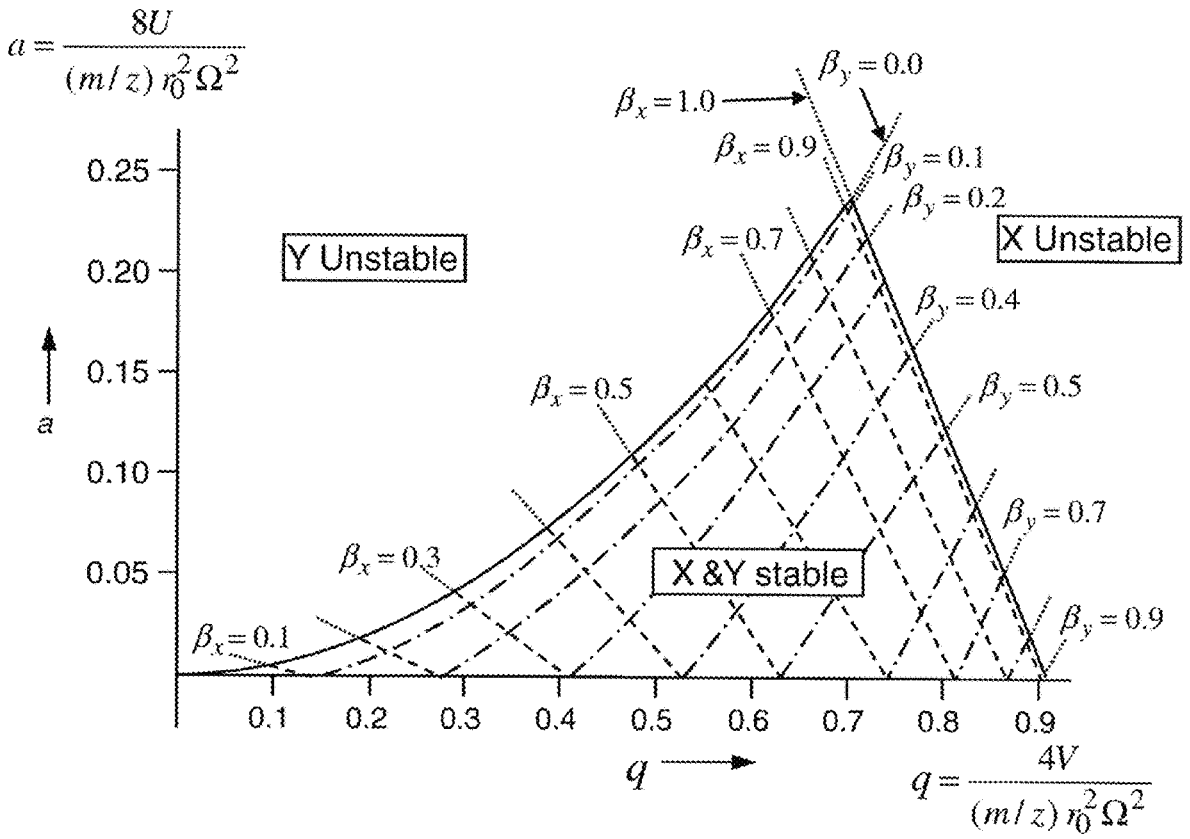
FIG. 8A is a depiction a Mathieu stability field diagram.
Figure 8B:
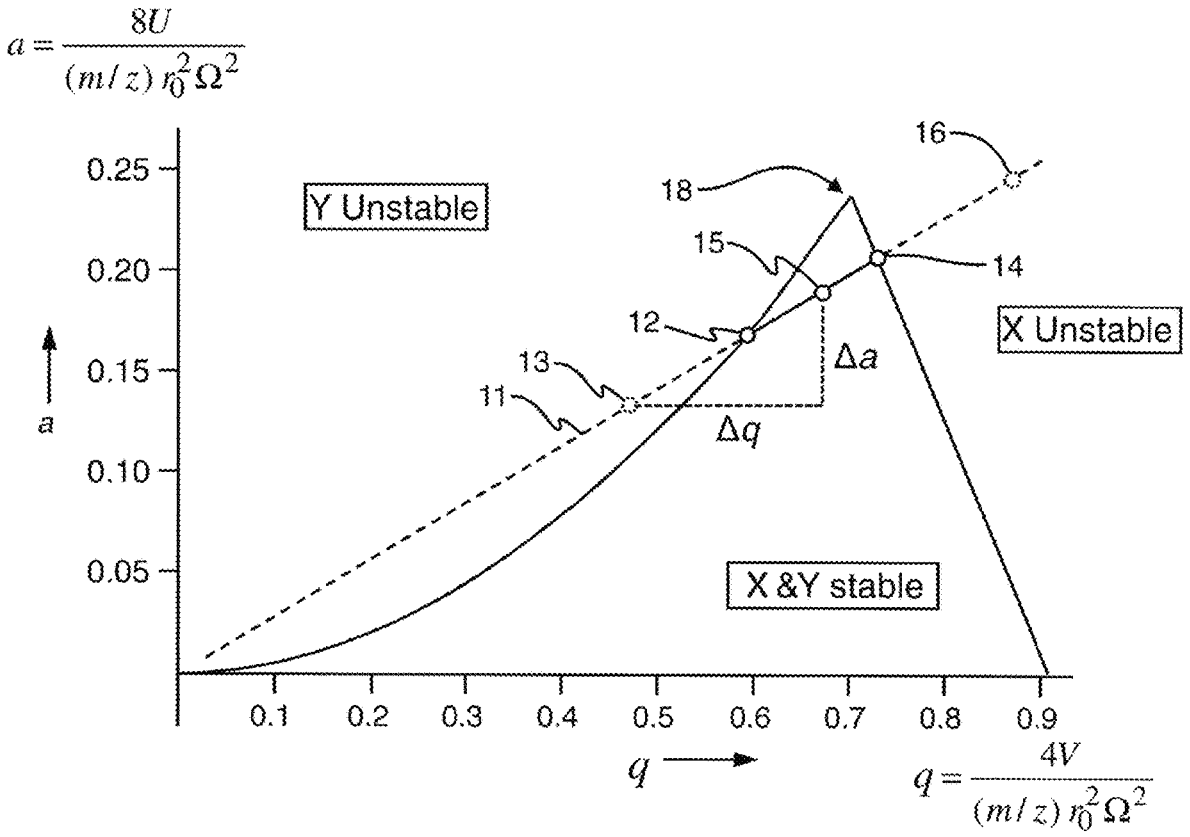
FIG. 8B (Prior Art)
FIG. 8B is a depiction of a Mathieu stability field diagram illustrating hypothetical points corresponding to first and second ion species both prior to and after a reconfiguration of a quadrupole mass filter that causes the filtering operation to change from transmission of the first ion species to transmission of the second ion species.

In the settling time formula that is employed in step 230 of method 200 (FIG. 3), the inventors' measurements indicate that A and B are electronics settling time coefficients whereas C is a time of flight (TOF) coefficient. FIG. 6 shows the settling time as a function of "jump distance", $\Delta(m/z)$, for several targeted ion species, where $\Delta(m/z)$ is the difference in m/z between a targeted ion species that is selectively transmitted immediately after an RF/DC voltage change and another targeted ion species that is selectively transmitted immediately prior to the voltage change. For each targeted m/z ion species, the settling time was measured at different values of Δ(m/z), both in a positive sense and in a negative sense. FIG. 6 depicts observed settling times only for positive values of Δ(m/z). As shown in FIG. 6, the inventors have determined that the settling time not only increases with an increase in Δ(m/z), for positive values of Δ(m/z), but also increases with m/z of the targeted ion species when Δ(m/z) is held constant. For example, the rightmost part of the graph in FIG. 6 shows the settling times for a few targeted ion species at a Δ(m/z) value of approximately 1000. The settling time for a target ion with m/z=69.0 Th at a Δ(m/z) value of approximately 1000 (i.e. a drop from m/z 1069.0 to m/z 69.0) is lower than the settling time for a second target mass with m/z=102.1 Th (i.e. a drop from m/z 1102.1 to m/z 102.1) and for a third target mass with m/z=215.2 Th (i.e. a drop from m/z 1215.2 to m/z 215.2). These differences are mainly due to the time of flight phenomenon that, at the same kinetic energy, heavier ions require a longer time to travel through a quadrupole than do lighter ions. FIG. 7 shows a nonlinear curve-fit representation using the data in FIG. 6. A plot (not shown) of fitted curves for settling times at negative values of Δ(m/z) is approximately but not exactly a mirror image of the curves shown in FIG. 7, with respect to the vertical y-axis. Thus, it is found that the coefficients, A and B, that are employed in the equations herein depend on the algebraic sign of Δ(m/z). This behavior has motivated the inventors to describe the settling time in terms of equations of the form shown in step 230 of method 200.

Returning to FIG. 2, it may be seen that, in accordance with the present teachings, the settling times $t_{s1}$, $t_{s2}$, $t_{s3}$, and $t_{s4}$ may be calculated using the following equations:

$$t_{s1}=A[(m/z)_2-(m/z)_1]^B+C\sqrt{(m/z)_2} \quad \text{Eq. (2a)}$$

$$t_{s2}=A[(m/z)_3-(m/z)_2]^B+C(m/z)_3 \quad \text{Eq. (2b)}$$

$$t_{s3}=A[(m/z)_4-(m/z)_3]^B+C\sqrt{(m/z)_4} \quad \text{Eq. (2c)}$$

$$t_{s4}=A[(m/z)_1-(m/z)_4]^B C\sqrt{(m/z)_1} \quad \text{Eq. (2d)}$$

where $(m/z)_1$ is the first mass-to-charge ratio, $(m/z)_2$ is the second mass-to-charge ratio, $(m/z)_3$ is the third mass-to-charge ratio, $(m/z)_4$ is the fourth mass-to-charge ratio and A, B and C are the empirically derived coefficients. As noted above, A and B are electronics settling time coefficients and C is a time of flight (TOF) coefficient.

Figure 4:
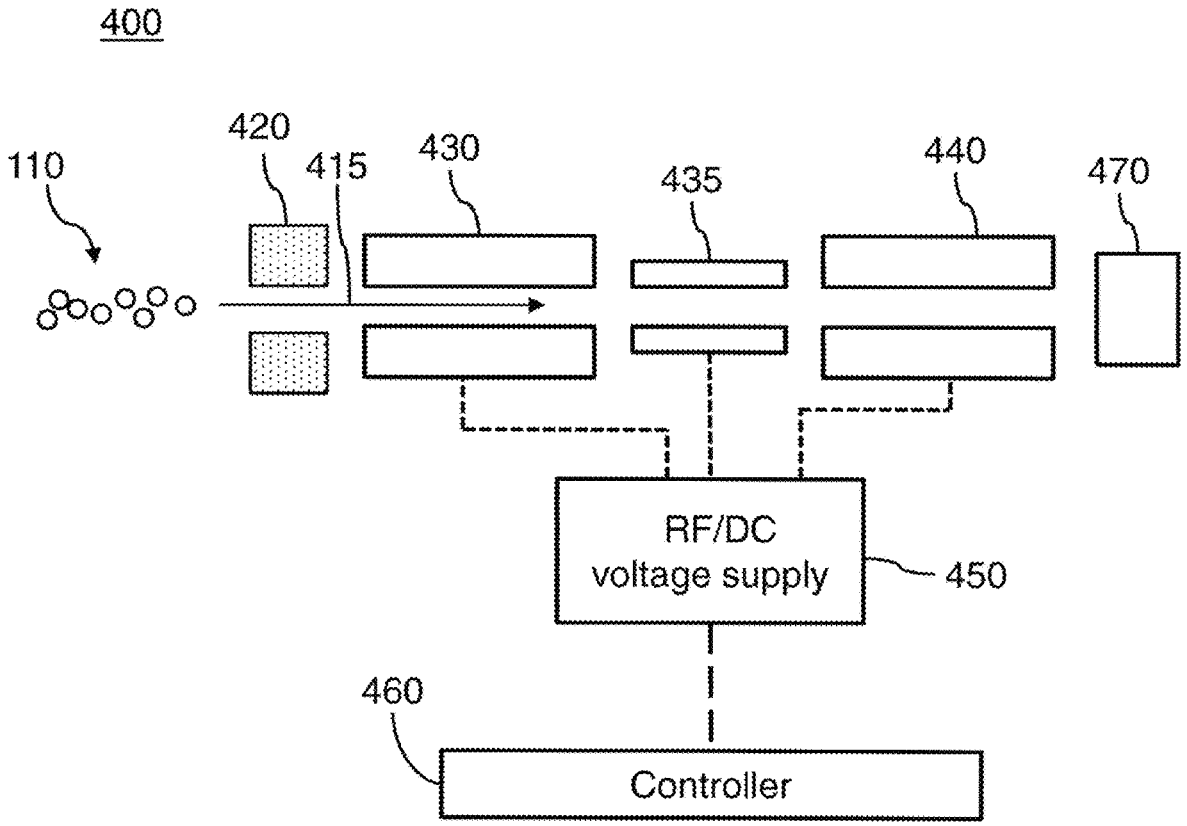
FIG. 4 illustrates a simplified schematic diagram of an example triple quadrupole mass filter apparatus which may be used to implement certain methods in accordance with the present teachings.

FIG. 4 illustrates a simplified schematic diagram of an example tandem mass spectrometer apparatus 400, such as a triple quadrupole mass spectrometer, which may be used to implement certain other aspects of the present teachings. Ions 110 comprising a sample are generated in an ionization source (not shown) and transmitted to a triple quadrupole mass spectrometer via one or more ion optical elements 420 such as, but not limited to, an ion funnel, a stacked ring ion guide, one or more ion guides, one or more ion lenses and one or more ion gating elements. The tandem quadrupole mass filter includes a first quadrupole mass filter 430, followed by a quadrupole collision cell 435, followed by a second quadrupole mass filter 440, followed by a detector 470. It is to be kept in mind that, as the diagram in FIG. 4 is highly schematic, certain common components of a full mass spectrometer system are not illustrated. Such components include a vacuum housing, various vacuum chambers within the housing, an ion source, vacuum pumps, vacuum hoses and connections, electrical connectors, a collision gas supply and supply lines, etc.

In various operational methods in accordance with the present teachings and still with reference to FIG. 4, the first quadrupole mass filter 430 is initially set to transmit parent or precursor ions having a specific pre-determined mass-to-charge ratio, (m/z) precursor, by means of appropriate applied RF and DC resolving voltages that are provided to the rod electrodes of the quadrupole mass filter 430. These parent or precursor ions are then fragmented in the quadrupole collision cell 435, which has an RF-only voltage applied thereto and a suitable collision gas therein, and the resulting fragment ions are directed towards the second quadrupole mass filter 440. The second quadrupole mass filter 440 is set to transmit only fragment ions (also known as product ions) having a specific pre-determined product-ion mass-to-charge ratio, $(m/z)_{product}$, towards ion detector 470 by the application of appropriately tuned RF and resolving DC voltages. The voltage supply system 450 is configured so as to supply the RF and resolving DC voltages to the various electrodes of the quadrupole mass filters comprising the triple quadrupole mass spectrometer and to supply RF voltage to the quadrupole collision cell. The voltage supply system 450 may communicate with and operate under the control of controller 460.

Figure 5:
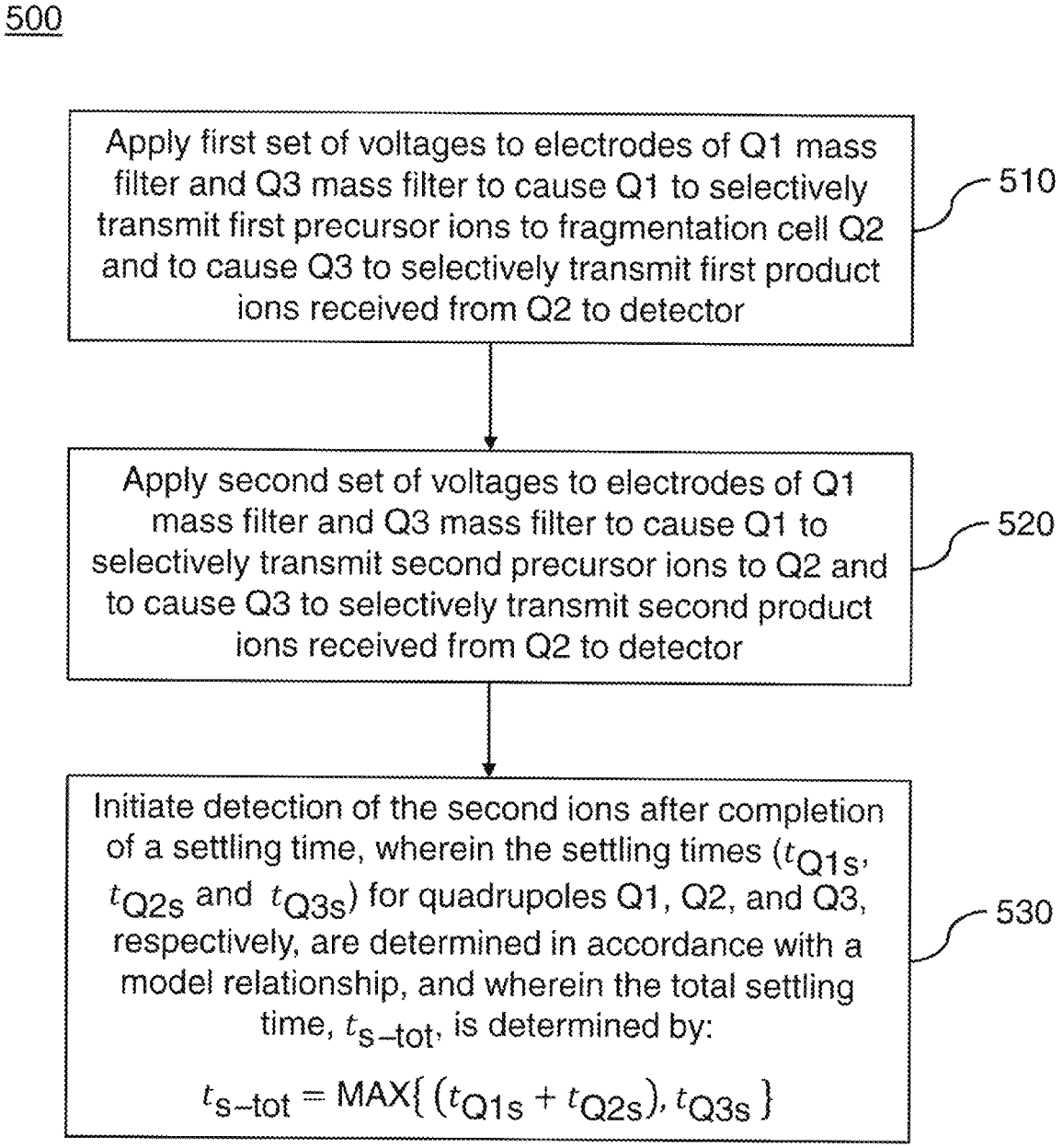
FIG. 5 is a flowchart depicting steps of a method, in accordance with the present teachings, for operating a triple quadrupole mass filter.

FIG. 5 is a flowchart depicting steps of a method of operating a tandem mass spectrometer apparatus, such as the triple quadrupole mass filter 400, in accordance with certain additional aspects of the present teachings. In step 510, a first set of voltages is applied to electrodes of the first quadrupole mass filter ("Q1 mass filter") and the second quadrupole mass filter ("Q3 mass filter") to cause the Q1 mass filter to selectively transmit first precursor ions to the collision cell Q2 and to cause the Q3 mass filter to selectively transmit first product ions that are received from the Q2 collision cell to a detector. In step 520, a second set of voltages is applied to electrodes of the Q1 mass filter and the Q3 mass filter to cause the Q1 mass filter to selectively transmit second precursor ions to the Q2 collision cell and to cause the Q3 mass filter to selectively transmit second product ions that are received from the Q2 collision cell to the detector. In step 530, detection of the second ions is initiated after completion of a total settling time, $t_{s\text{-}tot}$ that is calculated as $$t_{s\text{-}tot}=\text{MAX}\{(t_{Q1s}+t_{Q2s}),t_{Q3s}\} \quad \text{Eq. (3)}$$

where $t_{Q1s}$ is the settling time for Q1, $t_{Q2s}$ is the settling time, comprising only a time-of-flight term, for Q2, $t_{Q3s}$ is the settling time for Q3. The individual settling times for the Q1 mass filter, the Q2 collision cell, and the Q3 mass filter may be determined in accordance with the relationships:

$$t_{Q1s}=A[(m/z)_2-(m/z)_1]^B+C\sqrt{(m/z)_2} \quad \text{Eq. (4a)}$$

$$t_{Q2s}=C^*\sqrt{(m/z)_{p2}} \quad \text{Eq. (4b)}$$

$$t_{Q3s}=A[(m/z)_{p2}-(m/z)_{p1}]^B+C(m/z)_{p2} \quad \text{Eq. (4c)}$$

where $(m/z)_1$ is the first mass-to-charge ratio, $(m/z)_2$ is the second mass-to-charge ratio, $(m/z)_{p1}$ is the first product mass-to-charge ratio, $(m/z)_{p2}$ is the second product mass-to-charge ratio, and A, B, C and C* are empirically derived coefficients.

The discussion included in this application is intended to serve as a basic description. The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications may fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A method of operating a tandem mass spectrometer having a first quadrupole mass filter (Q1), and a second quadrupole mass filter (Q3), and a quadrupole collision cell (Q2) disposed between the first (Q1) and second (Q3) quadrupole mass filters, comprising:

applying a first set of RF and resolving DC voltages to electrodes of the first (Q1) and second (Q3) quadrupole mass filters to cause the first quadrupole mass filter (Q1) to selectively transmit first precursor ions and the second quadrupole mass filter (Q3) to selectively transmit first product ions;

applying a second set of RF and resolving DC voltages to electrodes of the first (Q1) and second (Q3) quadrupole mass filters to cause the first quadrupole mass filter (Q1) to selectively transmit second precursor ions and the third quadrupole mass filter (Q3) to selectively transmit second product ions, wherein at least one of: (i) the first and second precursor ions and (ii) the first and second product ions have mass-to-charge ratios that differ from one another; and initiating detection of the second ions after completion of a settling time, wherein the settling time for each quadrupole Q1, Q2, and Q3 is determined at accordance with the relationships:

$$t_{Q1s}=A[(m/z)_2-(m/z)_1]^B+C\sqrt{(m/z)_2},$$

$$t_{Q2s}=C^*\sqrt{(m/z)_{p2}},$$

$$t_{Q3s}=A[(m/z)_{p2}-(m/z)_{p1}]^B+C\sqrt{(m/z)_{p2}},$$

in which $t_{Q1s}$ is the settling time for Q1, $t_{Q2s}$ is the settling time for Q2, $t_{Q3s}$ is the settling time for Q3, $(m/z)_1$ is the first mass-to-charge ratio, $(m/z)_2$ is the second mass-to-charge ratio, $(m/z)_{p1}$ is the first product mass-to-charge ratio, $(m/z)_{p2}$ is the second product mass-to-charge ratio, and A, B, C and C* are empirically derived coefficients, wherein the total settling time is determined in accordance with the relationship:

$$t_{s\text{-}tot}=\mathrm{MAX}\{(t_{Q1s}+t_{Q2s}),t_{Q2s}\}.$$

2. The method of claim 1 wherein the settling time is determined for each targeted ion transition.

3. The method of claim 1 wherein A and B are electronics settling time coefficients, and C and C* are time of flight (TOF) coefficients.

4. The method of claim 3 wherein the values of A and B are dependent on whether the m/z of a next target ion is greater than or less than the m/z of a previous target ion.

* * * * *